United States Patent [19]

Hara et al.

[11] 4,438,736

[45] Mar. 27, 1984

[54] VARIABLE VALVE TIMING ARRANGEMENT WITH AUTOMATIC VALVE CLEARANCE ADJUSTMENT

[75] Inventors: Seinosuke Hara; Hiromichi Ofuji; Takaharu Gotou, all of Yokosuka, Japan

[73] Assignee: Nissan Motor Co., Ltd., Kanagawa, Japan

[21] Appl. No.: 356,269

[22] Filed: Mar. 9, 1982

[30] Foreign Application Priority Data

Mar. 10, 1981 [JP] Japan ..... 56-32190[U]

[51] Int. Cl.[3] ..... F01L 1/34

[52] U.S. Cl. ..... 123/90.16; 123/90.27; 123/90.46

[58] Field of Search ..... 123/90.16, 90.39, 90.21, 123/90.27, 90.44, 90.43, 90.46, 90.48, 90.15

[56] References Cited

U.S. PATENT DOCUMENTS

| | | | |
|---|---|---|---|
| 3,413,965 | 12/1968 | Gavasso | 123/90.16 |
| 3,618,574 | 11/1971 | Miller | 123/90.27 |
| 4,151,817 | 5/1979 | Mueller | 123/90.16 |
| 4,205,634 | 6/1980 | Tourtelot, Jr. | 123/90.16 |
| 4,285,310 | 8/1981 | Takizawa et al. | 123/90.16 |

FOREIGN PATENT DOCUMENTS

| | | | |
|---|---|---|---|
| 1750531 | 1/1970 | Fed. Rep. of Germany | 123/90.27 |
| 55-146213 | 11/1980 | Japan | 123/90.27 |
| 1527743 | 10/1978 | United Kingdom | 123/90.15 |

*Primary Examiner*—Ira S. Lazarus
*Assistant Examiner*—R. S. Bailey
*Attorney, Agent, or Firm*—Lowe, King, Price & Becker

[57] ABSTRACT

A variable valve timing system has a lever pivoted at one end on a piston reciprocally disposed in a cylinder and the other end in engagement with a poppet valve. A first cam cooperates with a second bell crank lever like cam which is eccentrically mounted on a rotatable shaft. Rotation of this shaft moves the second cam toward or away from the engine proper to vary the movement of the lever with which the second cam cooperates. The piston is biased out of the cylinder by a spring and maintained in position by hydraulic fluid introduced into the cylinder through a one way flow arrangement.

11 Claims, 3 Drawing Figures

VARIABLE VALVE TIMING ARRANGEMENT WITH AUTOMATIC VALVE CLEARANCE ADJUSTMENT

BACKGROUND OF THE INVENTION

1. Field of the Invention

The present invention relates generally to a variable valve timing system and more specifically to a variable valve timing system which includes an arrangement for automatically maintaining the valve clearance essentially zero during all modes of operation.

2. Description of the Prior Art

In a previously proposed arrangement (shown in FIG. 1) a rotatable cam 1 operatively contacts one end of a rocker arm 3 which is eccentrically journalled on a rocker shaft 5. The other end of the rocker arm 3 is in contact with a swingable cam 4 which is journalled on a shaft 7. As shown the swingable cam 4 is adapted to operatively abut the head section of a popper valve 8.

However, this arrangement suffers from the drawback that, as the cam is mounted on the shaft 7, the clearance between the cam and the head section of the valve 8 cannot be readily adjusted and a noise generating clearance must be provided therebetween.

For a full and complete disclosure of the above described arrangement, reference is made to U.S. patent application Ser. No. 138,792 filed on Apr. 8, 1980 in the name of Shunichi AOYAMA.

SUMMARY OF THE INVENTION

The present invention features a variable valve timing system having a lever which is pivoted at one end on a hydraulic cylinder/piston arrangement and which abuts the top of a valve stem at the other. A first cam cooperates with a second "bell crank lever-like" cam which is eccentrically mounted on a rotatable shaft. The second cam may be moved with respect to the cylinder head via rotation of the shaft on which it is mounted to vary the cooperation between it and the lever to accordingly vary the valve lift and timing.

The cylinder/piston arrangement moves the fulcrum or pivot point of the lever in response to a clearance or, vice versa, an excessive surface pressure being developed between the top of the valve stem and the lever, to maintain a zero valve clearance and predetermined surface pressure therebetween.

BRIEF DESCRIPTION OF THE DRAWINGS

The features and advantages of the present invention will become more clearly appreciated from the following description taken in conjunction with the accompanying drawings in which like reference numerals are used to denote corresponding elements, and in which.

DETAILED DESCRIPTION OF THE PREFERRED EMBODIMENTS

Figure 1:
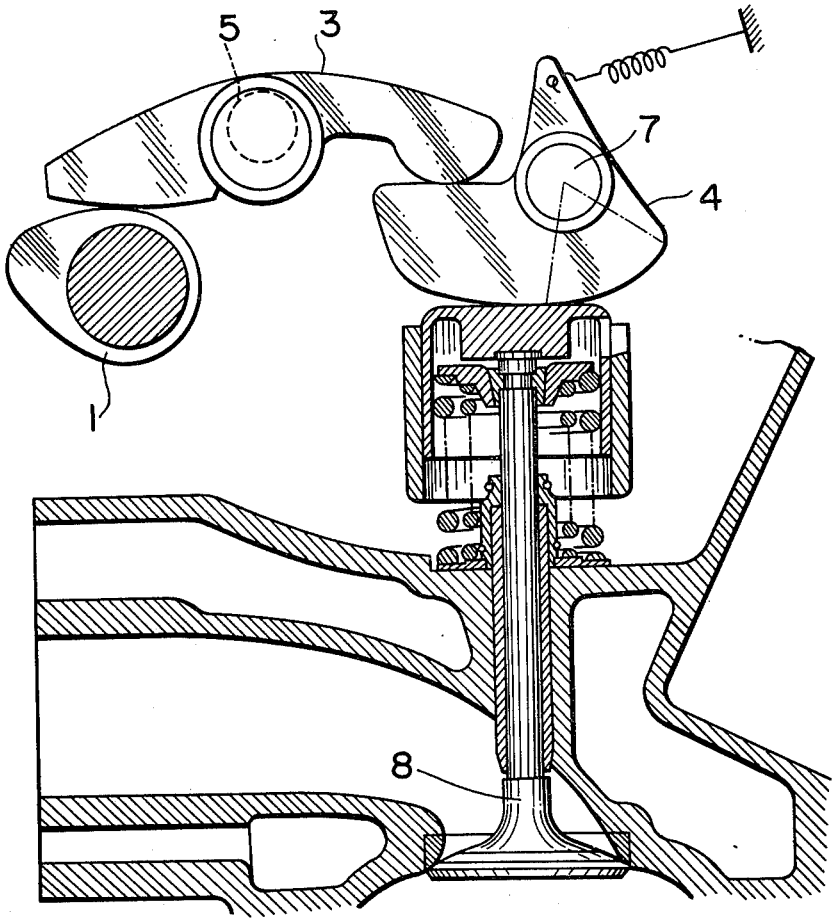
FIG.1 Prior Art
FIG. 1 is a sectional elevation of the prior art arrangement described in the opening paragraphs of the instant disclosure.
Figure 2:
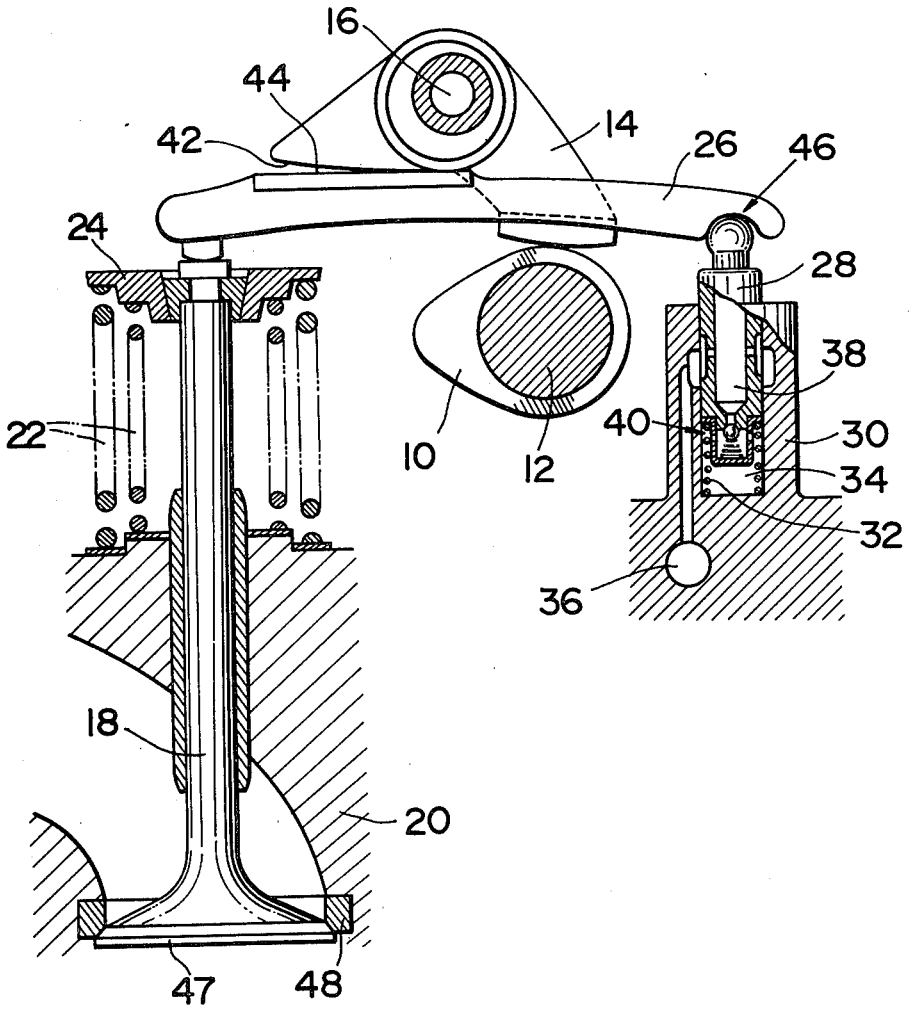
FIG. 2 is a sectional elevation of a preferred embodiment of the present invention.
Figure 3:
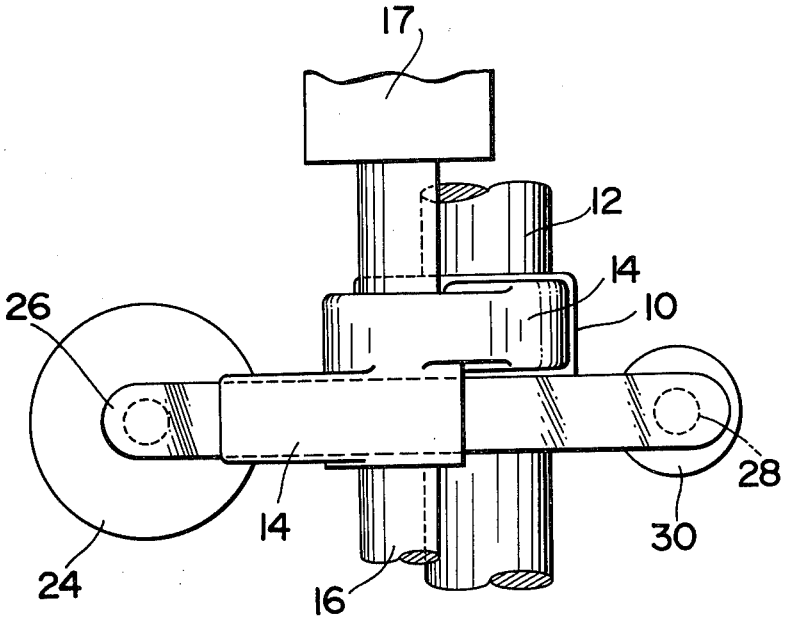
FIG. 3 is a plan view of the arrangement shown in FIG. 2.

Turning now to FIGS. 2 and 3 of the drawings a preferred embodiment of the present invention is shown. In this arrangement a cam 10 is fixedly mounted on a rotatable cam shaft 12 and is adapted to engage a second "bell crank lever-like" cam 14 which is eccentrically journalled on a rotatable shaft 16. The shaft 16 is rotatable via a mechanism 17 in accordance with various operating parameters of the engine, such as RPM and load.

A poppet valve 18 is disposed as shown, in the cylinder head 20 of an internal combustion engine, and biased to a closed position by valve springs 22. The springs 22 are interposed between the cylinder head 20 and a spring retainer 24. A valve operating lever 26 is arranged to abut the top of the valve stem at one end thereof, and to be pivotally supported at the other end by a "ball joint-like" arrangement provided at the top of a piston 28. The piston 28 is, as shown, reciprocally disposed in a hydraulic cylinder 30 incorporated in the cylinder head 20 and biased to project thereoutof by a spring 32. The piston 28 defines a closed variable volume chamber 34 in the cylinder 30, which chamber communicates with an oil passage 36 formed in the cylinder head 20, via a fixed volume chamber 38 formed within the piston 28 per se and a one way check valve 40 (in this case a ball valve). The oil passage 36 is fluidly connected with an oil pump of the engine so as to be constantly filled with hydraulic fluid.

With this arrangement when the engine is started and the cam shaft 12 and cam 10 rotate, the cam 14 is periodically cammed by the first cam 10 to pivot about the shaft 16. The cam 14 and the valve operating lever 26 are respectively formed with a cam surface 42 and an essentially flat surface 44, which cooperate to transmit the motion of the cam 14 to the lever 26. Thus, when the cam 14 is cammed to rotate in the counterclockwise direction, the lever 26 is caused to pivot about the pivot point 46 defined at the top of the piston 28 and accordingly to drive the valve 18 downwardly (as seen in the drawings) to ift the valve head 47 from the valve seat 48.

The operation of the hydraulic cylinder/piston arrangement 30/28 is such that if, for any one of various reasons such as valve wear or a thermally induced valve contraction, a clearance occurs between the top of the valve stem and the lever 26, the spring 32 will bias the piston in a direction out of the cylinder 30 and the oil pressure maintained within the passage 36 will open the ball valve and introduce an additional amount of hydraulic fluid into the variable volume chamber 34. The piston 28 is accordingly caused to project a little further out of the cylinder 30 to accordingly cause the lever 26 to rotate in the counter-clockwise direction (about a fulcrum defined by the contact point between the surfaces 42, 44) and reduce the clearance to zero again. Now, as the spring 32 is weaker than the valve springs 22, during any one valve lift operation, the lever 26 will firstly tend to rotate clockwise about a fulcrum defined between the lever 26 and the top of the valve stem as the lobe of the cam 10 induces the cam 14 to pivot in the counterclockwise direction. This rotation compresses the spring 32 and the hydraulic fluid retained in the variable volume chamber 34. Although some of the fluid is displaced from the chamber through the clearance defined between the piston 28 and the cylinder wall and ball valve, the descent of the piston 28 is relatively small whereafter the fluid acts as a "quasi solid body" causing the lever 26 to pivot about the pivot 46 in the counter-clockwise direction to open the valve 18. After each valve lift operation the spring again biases the piston upwardly (as seen in the drawings) and any fluid displaced from the chamber is immediately replaced through the ball valve thus maintaining the zero valve clearance.

On the other hand, should the valve stem elongate due to thermal expansion or wear and cause the valve stem to exert an unwantedly high surface pressure on the lever 26, the lever tends to rotate in the clockwise direction about a fulcrum point defined between the cam surface 42 and the flat surface 44, whereby piston 28 is biased back into the cylinder 30 pressurizing the hydraulic fluid to the degree that some of the fluid is displaced from the chamber (via the clearance defined between the piston and the cylinder wall and/or the ball valve) to allow the piston to slowly descend into the cylinder until the lever 26 rotates in the clockwise direction sufficiently to reduce the excess surface pressure developed between the lever 26 and the top of the valve stem.

When it is desired to vary the degree of valve lift and the shaft 16 is rotated from its illustrated position in the clockwise direction, the cam 14 as a whole is moved upwardly with respect to the cylinder head 20 with the result that the lift of the poppet valve 18 is decreased due to the displacement of the cam 14 with respect to the cam 10. The opening of the valve 18 is accordingly delayed while the closure is induced at an earlier timing so that the overall opening of the valve is reduced. Conversely, if the shaft 16 is rotated in the counterclockwise direction the lever cam 14 is lowered toward the cylinder head 20 with a resulting increased valve lift and time for which the valve is open.

However, when the cam 14 is moved away from the cylinder head 20 via rotation of the shaft 16 the cam surface 42 and the flat surface 44 tend to seperate. Under these circumstances, the hydraulic cylinder/piston arrangement 30/28 again functions to induce the lever to rotate in the counterclockwise direction (about a fulcrum defined at the top of the valve stem) to induce the surfaces 42,44 to re-engage and simultaneously maintain a zero valve clearance. In the reverse case where the cam 14 is lowered toward the cylinder head to increase valve lift, the excessive surface pressure thus developed between the surfaces 42, 44 induces the lever 26 to rotate in the clockwise direction with the contact between the lever and the top of the valve stem acting as the fulcrum. The piston 28 is thus biased to descend into the cylinder 30 in a manner previously described to reestablish the desired equilibrium between the lever 26, cam 14, valve stem and piston 28.

What is claimed is:

1. In an internal combustion engine, a valve for controlling a port;

a lever which abuts said valve at a first end thereof;

a piston which is biased in one direction and on which a second end of said lever is pivotally mounted;

a cam which is rotatable in synchronism with a crankshaft of said engine;

a second lever which abuts said cam at a first end thereof and which abuts said lever at a second end thereof; and support means which pivotally supports said second lever at a location between the first and second ends thereof, said support means being operative to move an axis about which said second lever pivots in first and second directions to increase and decrease the lift of said valve, respectively.

2. An internal combustion engine as claimed in claim 1, wherein said second lever has an essentially bell crank-like shape and wherein said suppost means therefor takes the form of a shaft on which said second lever is eccentrically journalled, said shaft being selectively rotatable in accordance with selected engine operating parameters.

3. An internal combustion engine as claimed in claim 1 wherein said piston is reciprocatively disposed in a cylinder fixed to a cylinder head of said engine, said piston defining a closed variable volume chamber in said cylinder, said chamber being communicable with a source of hydraulic fluid through a check valve which permits fluid flow into said chamber.

4. An internal combustion engine as claimed in claim 3, wherein said cylinder and said piston define a clearance therebetween through which hydraulic fluid may be displaced from said chamber.

5. An internal combustion engine as claimed in claim 3, wherein said support means is operable for moving said axis in said first and second directions continuously within predetermined limits.

6. In an internal combustion engine, a valve assembly comprising:

a variable valve timing means for varying an amount of valve lift of said valve assembly;

said variable timing means comprising a rocker arm means pivoted at one end thereof on an adjustable support means and abutting the top of a valve stem at the other end thereof;

a cam for causing said rocker arm means to displace said valve stem;

an actuating means, contacting both said cam and said rocker arm means and operable for transmitting movement of said cam to said rocker arm means; and fulcrum setting means connected to and providing an adjustably positioned fulcrum for rotation of said rocker arm means about said adjustable support means, thereby to adjust valve lift for the valve assembly.

7. A valve assembly as recited in claim 6 wherein said fulcrum setting means and said actuating means are formed on a single member.

8. A valve assembly as recited in claim 6 wherein said fulcrum setting means comprises a structure eccentrically journalled about a shaft and having a curved cam surface contacting a flat surface of said rocker arm at an adjustable location forming said fulcrum and determinded by the rotation of said shaft.

9. A valve assembly as recited in claim 8 further comprising means for rotating said shaft and thereby adjusting said valve lift responsively to various operating parameters of said engine.

10. A valve assembly as recited in claim 8 wherein said eccentrically journalled structure and said actuating means are formed on a single member.

11. A valve assembly as recited in claim 10 wherein said single member is a bell crank lever-like cam.

* * * * *